United States Patent [19]

Knickerbocker

[11] Patent Number: 4,463,999

[45] Date of Patent: Aug. 7, 1984

[54] ELECTRICAL CONNECTOR HOLD-DOWN ADAPTOR

[75] Inventor: Robert H. Knickerbocker, Cheshire, Conn.

[73] Assignee: The Siemon Company, Watertown, Conn.

[21] Appl. No.: 365,200

[22] Filed: Apr. 5, 1982

Related U.S. Application Data

[63] Continuation-in-part of Ser. No. 145,621, May 1, 1980, Pat. No. 4,343,525.

[51] Int. Cl.[3] ..... H01R 13/639

[52] U.S. Cl. ..... 339/75 P; 339/104

[58] Field of Search ..... 339/75 P, 91 R, 104; 248/499

[56] References Cited

U.S. PATENT DOCUMENTS

| | | | |
|---|---|---|---|
| 3,313,511 | 4/1967 | Koerner et al. | 248/499 |
| 4,043,627 | 8/1977 | Ayer | 339/91 R X |
| 4,121,880 | 10/1978 | Rollins | 339/104 X |

*Primary Examiner*—Eugene F. Desmond

*Attorney, Agent, or Firm*—Fishman & Dionne

[57] ABSTRACT

An adaptor which permits mating electrical cable connectors to be easily and reliably secured to one another comprises a bracket and a self-locking strap, the bracket being positioned between the connectors and the strap extending from the bracket and passing completely around the mated connectors.

9 Claims, 3 Drawing Figures

ELECTRICAL CONNECTOR HOLD-DOWN ADAPTOR

CROSS REFERENCE TO RELATED APPLICATIONS

This application is a continuation-in-part of application Ser. No. 145,621 filed May 1, 1980, now U.S. Pat. No. 4,343,525.

BACKGROUND OF THE INVENTION

This invention relates to reliably and easily preventing undesired separation of the mating portions of communications systems cable connectors. Specifically, this invention relates to securing mating electrical cable connectors to one another with ease through the use of a universal adaptor characterized by minimal cost.

A problem instant to the use of presently available cable connectors for establishing electrical connections between the conductors of a pair of multi-conductor communications cables resides in the fact that the connectors may disengage while in service. The prior art discloses numerous methods to alleviate this problem. Thus, for example, some cable connectors are manufactured and designed so that they snap together. Other previously employed methods of fastening cable connectors together involve the use of bail hooks, springs or similar devices. Also, many cable connectors are provided with threaded fittings whereby the male and female connectors may be joined together by means of bolts.

While the prior art demonstrates various methods of securing mating cable connectors together, these prior methods all have one or more deficiencies. Thus, by way of example, those prior art connectors which are manufactured so as to be self-fastening cannot be employed with non-compatible connectors and thus their usefulness is limited. Further, the joining and disconnecting of prior art cable connectors, particularly those that are bolted together, is a time consuming and thus expensive procedure. Additionally, the prior art securing techniques do not aid in identifying specific cables, this being a particular problem when the cables are located in a crowded environment.

SUMMARY OF THE INVENTION

The present invention overcomes the above-discussed disadvantages of the prior art by providing a novel and improved method of simultaneously releaseably securing mating cable connectors to one another and identifying the associated cables. Apparatus in accordance with the present invention employs a bracket having an apertured portion which is sized and shaped to circumscribe the mating portions of the connectors. The bracket is provided with at least one slotted extension to which a self-locking strap is secured. In use, after the bracket has been placed on the first connector and the mating connector joined thereto, the self-locking strap will be wound tightly around the pair of connectors and locked to itself to thereby retain the connectors in the engaged condition. The connectors may be disengaged merely be applying sufficient force to the strap so as to unlock it from itself. Through the use of color-coded straps, the cables extending from the connectors may be labeled according to function.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and wherein.

DESCRIPTION OF THE PREFERRED EMBODIMENT

Figure 1:
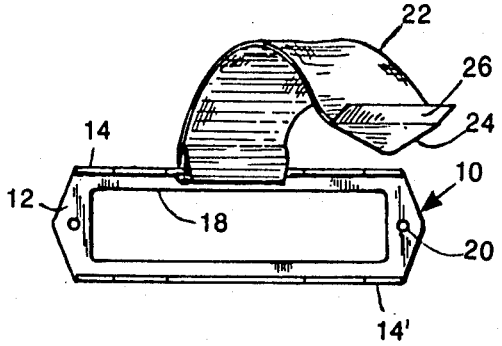
FIG. 1 is a top view of an adaptor in accordance with the present invention.
Figure 2:
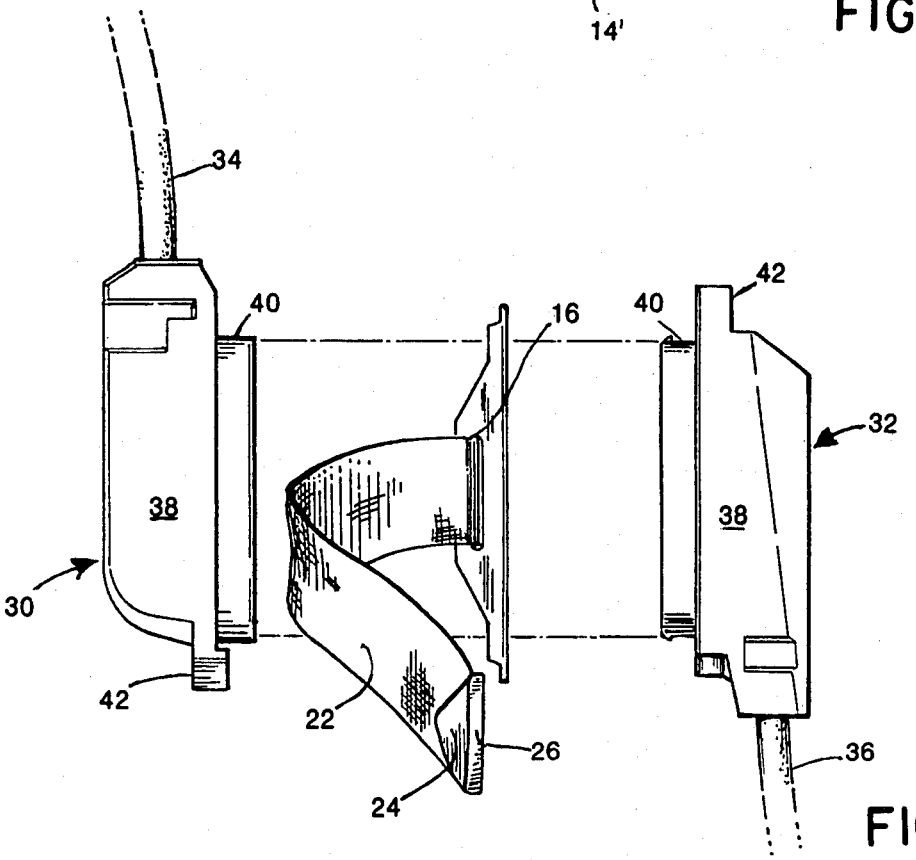
FIG. 2 is an exploded view representing the manner of use of the adaptor of FIG. 1 to join a pair of cable connectors.

Referring to the drawing, an adaptor in accordance with the present invention comprises a bracket, indicated generally at 10, which is preferably formed as a metal stamping. Thus, bracket 10 is generally U-shaped with a flat bottom portion 12 and a pair of flat arms 14, 14' which extend outwardly therefrom. The arms 14, 14' are preferably transversely oriented with respect to base 12 and have the irregular shape which may best be seen from FIG. 2. The arms 14, 14' are provided with slots 16 (FIG. 2). The flat base 14 is provided with a rectangularly shaped central cut-out 18. Additionally, in the preferred embodiment, base 12 is provided with a pair of oppositely disposed and aligned circular mounting holes 20.

The adaptor of the present invention further comprises a strap 22 which is of the self-locking type. Thus, strap 22 may be comprised of "Velcro". A first portion of strap 22 will be provided, on one side, with hooks while a second portion of the strap will be provided, on the opposite side, with loops which are engaged by the hooks when the two portions of the strap are placed in contact with one another. In the preferred embodiment the strap 22 is also provided, at a first end thereof, with a tab 24. Tab 24 may be defined simply by heat sealing the strap to itself in a region 26 of one of the aforesaid portions thereof. The end of strap 22 disposed oppositely to tab 24 will be passed through one of the slots 16 in an outwardly extending arm 14 of bracket 10 and permanently secured to the bracket. The permanent attachment of the end of strap 22 to bracket 10 may be accomplished by doubling the strap back on itself to define a loop, a portion of the arm 14 of the bracket 10 passing through this loop, and then heat sealing or otherwise permanently sealing closed the loop.

Figure 3:
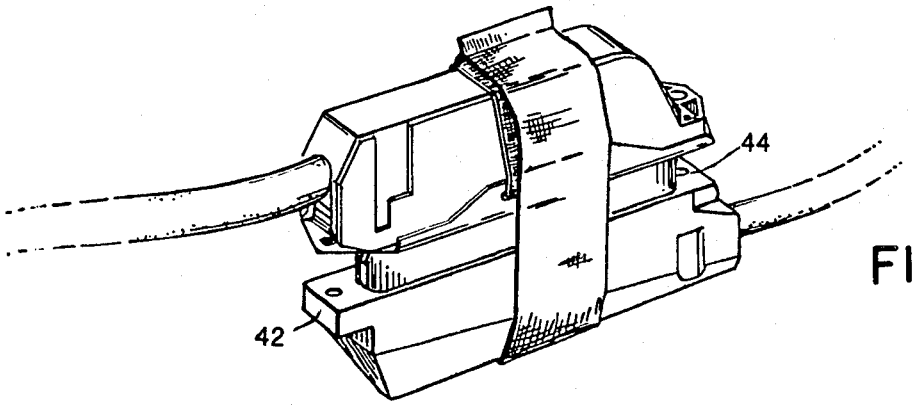
FIG. 3 is a perspective view which depicts the present invention as employed to join a pair of cable connectors.

Electrical cable connectors of the type which will be secured together through the use of the adaptor of the present invention are depicted in FIGS. 2 and 3 at 30 and 32. The cable connectors 30 and 32 will typically include two rows of contacts with the contacts in the rows being individually electrically connected to single conductors of respective of multi-conductor cables 34 and 36. The connectors 30 and 32 each have a main body portion 38 comprised of a suitable non-conductive plastic material. Terminal protectors 40 extend outwardly from the body portions 38 of the connectors and define recesses in which the individual conductor terminations, i.e., the connector contacts, are disposed. The contacts will typically be in the form of elongated copper members which have a certain degree of resiliency. In a typical case the contacts in connector 30 will be disposed in parallel rows along the opposite sides of a support which is centrally located within the protector 40 while the contacts of connector 32 will actually be supported in recesses in the side wall of the protector 40. When the connectors are mated, the protector 40 of connector 32 will fit inside of the protector 40 of connector 30 with the size and shape of the protectors 40 being such as to guide the contacts into engagement to establish electrical connections between the individual conductors of cables 34 and 36. The connectors 30 and 32 are also provided with apertured extensions 42, the apertures typically being provided with internal threads, as well as internally threaded holes 44 whereby a pair of engaged connectors may be secured together through the use of a pair of bolts.

In the use of the present invention the protector 40 of connector 30 is passed through the cut-out 18 in bracket 10 and connector 32 is subsequently mated with connector 30. With the connectors thus joined the strap 22 is wrapped tightly around the connectors and secured to itself, as shown in FIG. 3, to fasten connector 30 to connector 32. The straps 22 may be color coded to facilitate identification of the extended cable 34, 36.

The holes 20 in bracket 10 are positioned so as to be aligned with the apertures in the extensions 42 and the threaded holes 44 of the connectors whereby, should it be desired to use the present invention solely for cable identification purposes, the connectors 30 and 32 may still be bolted together.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A retainer for releasably securing together a pair of mating electrical cable connectors, the cable connectors each having a body portion and a connection portion extending outwardly therefrom, the connection portions being adapted to mate with each other, said retainer comprising:

a rigid bracket, said bracket having a substantially planar base portion and at least a first arm extending outwardly from said base portion at an angle, said arm having a slot extending therethrough, said base portion having an aperture extending therethrough, said aperture having a size and shape which permits the connector extensions to pass therethrough, said aperture having a crosssectional area which is smaller than the cross-sectional area of the connector body portions, said bracket being intended for positioning between a pair of connectors; and a flexible strap, said strap including a first portion having loops extending outwardly from a first side thereof and a second portion having flexible hook members extending outwardly from a second side thereof, said hooks and loops cooperating when brought into contact to releasably secure said first strap portion to said second strap portion after said flexible strap is wrapped around both of a pair of connectors, said strap further being folded on and permanently secured to itself to form a loop at a first end thereof, said strap passing through said slot in said bracket arm in the region of said loop whereby said strap is attached to said bracket.

2. The retainer of claim 1 wherein said aperture in said bracket base portion is of rectangular shape.

3. The retainer of claim 1 wherein said first arm defines a plane which is generally transverse to said base portion.

4. The retainer of claim 2 wherein said first arm defines a plane which is generally transverse to said base portion.

5. The retainer of claim 1 further comprising:

a second arm extending outwardly from said base portion at an angle, said second arm being disposed at the opposite side of said aperture with respect to said first arm.

6. The retainer of claim 5 wherein said arms are substantially parallel.

7. The retainer of claim 6 wherein said aperture in said base portion is of rectangular shape.

8. The apparatus of claim 1 wherein said bracket is comprised of metal.

9. The apparatus of claim 7 wherein said bracket is comprised of metal.

* * * * *